US008726507B2

(12) United States Patent
Bajusz et al.

(10) Patent No.: US 8,726,507 B2
(45) Date of Patent: May 20, 2014

(54) METHOD FOR MANUFACTURING A HEAT EXCHANGER AND EXCHANGER OBTAINED BY THE METHOD

(75) Inventors: Denis Bajusz, Remicourt (BE); Albert Cornet, Verviers (BE); Bruno Servais, Avennes (BE)

(73) Assignee: Techspace Aero S.A., Milmort (BE)

( * ) Notice: Subject to any disclaimer, the term of this patent is extended or adjusted under 35 U.S.C. 154(b) by 588 days.

(21) Appl. No.: 12/891,162

(22) Filed: Sep. 27, 2010

(65) Prior Publication Data

US 2011/0079378 A1 Apr. 7, 2011

(30) Foreign Application Priority Data

Oct. 1, 2009 (EP) ..... 09171981

(51) Int. Cl.

| | |
|---|---|
| ***B21D 53/02*** | (2006.01) |
| ***B23P 15/26*** | (2006.01) |
| ***B23K 1/00*** | (2006.01) |
| *F28F 3/02* | (2006.01) |

(52) U.S. Cl.

USPC ..... 29/890.039; 29/890.043; 29/890.054; 219/615; 165/170

(58) Field of Classification Search

USPC ..... 29/890.03, 890.038, 890.039, 890.04, 29/890.043, 890.054; 219/615, 659; 165/169, 170, 168

See application file for complete search history.

(56) References Cited

U.S. PATENT DOCUMENTS

| | | | | |
|---|---|---|---|---|
| 1,369,806 | A * | 3/1921 | Hanmer | 29/890.03 |
| 1,996,808 | A * | 4/1935 | Heitman | 62/515 |
| 2,051,277 | A * | 8/1936 | Stevens | 165/170 |
| 2,438,851 | A * | 3/1948 | Gates | 165/8 |

(Continued)

FOREIGN PATENT DOCUMENTS

| | | | |
|---|---|---|---|
| DE | 24 12 862 | A1 | 10/1975 |
| DE | 2412862 | A * | 10/1975 |

(Continued)

*Primary Examiner* — David Bryant

*Assistant Examiner* — Jason L Vaughan

(74) *Attorney, Agent, or Firm* — Reinhart Boerner Van Deuren P.C.

(57) ABSTRACT

The present invention relates to a method for manufacturing an air/fluid heat exchanger (1), said method comprising at least the following steps:

a) on a first sheet metal plate (2), a plurality of tight folds are formed, said folds acting as fins (3),
   or, alternatively, the first sheet metal plate (2) comprising a first portion (2*a*) and a second portion (2*b*), tight folds (3) are formed only on the first portion (2*a*);
   said first sheet metal plate (2) or said first portion (2*a*) forming a sheet metal plate in the upper position;

b) the tight folds (3) are opened on a portion across their height;

c) the first sheet metal plate (2) obtained in step b) is placed on a second sheet metal plate (6), said second sheet metal plate (6) forming a sheet metal plate in the lower position,
   or, alternatively, the first portion (2*a*) obtained in step b) is folded on the second portion (2*b*), said second portion (2*b*) forming a sheet metal plate in the lower position, d) the tight portion of the folds (3) is brazed and the first sheet metal plate (2) is brazed onto the second sheet metal plate (6),
   or, alternatively, the tight portion of the folds (3) is brazed and the first portion (2*a*) is brazed onto the second portion (2*b*);

e) optionally, a third sheet metal plate (7) is placed and brazed underneath the sheet metal plate in the lower position; said third sheet metal plate forming then, the sheet metal plate in the lower position.

18 Claims, 4 Drawing Sheets

(56) References Cited

U.S. PATENT DOCUMENTS

| | | | | | |
|---|---|---|---|---|---|
| 2,514,469 | A | * | 7/1950 | Burkhardt | 29/890.042 |
| 3,265,121 | A | * | 8/1966 | Hickman | 165/49 |
| 3,425,113 | A | * | 2/1969 | Ward, Jr. | 228/173.7 |
| 3,479,731 | A | * | 11/1969 | Mantel et al. | 228/182 |
| 3,496,324 | A | * | 2/1970 | Harper | 219/85.15 |
| 3,537,165 | A | * | 11/1970 | Kemp et al. | 29/890.039 |
| 3,592,993 | A | * | 7/1971 | Bennett | 219/83 |
| 3,797,087 | A | * | 3/1974 | Allardyce et al. | 29/890.034 |
| 3,901,309 | A | * | 8/1975 | Thebert | 165/8 |
| 4,002,200 | A | | 1/1977 | Raskin | |
| 4,253,520 | A | * | 3/1981 | Friedericy et al. | 165/166 |
| 4,263,966 | A | * | 4/1981 | Ostbo | 165/134.1 |
| 4,470,453 | A | * | 9/1984 | Laughlin et al. | 165/166 |
| 4,492,268 | A | * | 1/1985 | Uehara et al. | 165/166 |
| 4,843,693 | A | * | 7/1989 | Chisholm | 29/890.054 |
| 5,082,167 | A | * | 1/1992 | Sadano et al. | 228/258 |
| 5,386,629 | A | * | 2/1995 | Ouchi et al. | 29/890.046 |
| 5,462,113 | A | * | 10/1995 | Wand | 165/167 |
| 5,504,296 | A | * | 4/1996 | Sato et al. | 219/85.1 |
| 5,979,542 | A | * | 11/1999 | Inoue et al. | 165/133 |
| 6,412,174 | B1 | * | 7/2002 | Kawano et al. | 29/890.053 |
| 6,799,630 | B1 | * | 10/2004 | Kato et al. | 165/177 |
| 6,962,194 | B2 | * | 11/2005 | Martin et al. | 165/170 |
| 7,140,107 | B2 | * | 11/2006 | Ohno et al. | 29/890.039 |
| 7,690,113 | B2 | * | 4/2010 | Althofer | 29/890.039 |
| 8,191,615 | B2 | * | 6/2012 | So et al. | 165/140 |
| 2007/0245560 | A1 | * | 10/2007 | Matsuzaki et al. | 29/890.039 |
| 2007/0295490 | A1 | * | 12/2007 | Haegele | 165/134.1 |

FOREIGN PATENT DOCUMENTS

| | | | |
|---|---|---|---|
| EP | 0 982 427 | A1 | 3/2000 |
| FR | 1 566 662 | A | 5/1969 |
| JP | 04 086489 | A | 3/1992 |

* cited by examiner

METHOD FOR MANUFACTURING A HEAT EXCHANGER AND EXCHANGER OBTAINED BY THE METHOD

CROSS-REFERENCE TO RELATED APPLICATIONS

This patent application claims the benefit of European Patent Application No. 09171981.5, Oct. 1, 2009, the entire teachings and disclosure of which are incorporated herein by reference thereto.

FIELD OF THE INVENTION

The present invention relates to a method for manufacturing a surface air/fluid heat exchanger. It relates more particularly, but not exclusively, to a method for manufacturing a surface air/oil heat exchanger that may be used in a turbine engine.

The present invention also relates to the heat exchanger obtained by the method.

STATE OF THE ART

In the case of a turbine engine, various bodies and equipment must be lubricated and/or cooled, the generated heat generally being transported by oil systems and evacuated by fuel-oil and/or air-oil exchangers. In the latter, also called ACOC (Air Cooled Oil Cooler), a flow of forced air is induced onto an exchange surface connected to the oil circuit. A surface exchanger is preferred to a compact block exchanger; the first being less disruptive to the flow of air and to the operation of the turbine engine. The exchange surface may consist of a plate provided with fins or similar components, specific to exchange heat with a stream of cold air flowing parallel to the plate.

In the state of the art, there are several methods for manufacturing air-oil surface exchangers. These methods have problems in terms of manufacturing and costs or even problems of thermal efficiency.

For the air circuit, a first manufacturing method may be cited, which consists in moulding, extruding or machining a plate comprising fins that are parallel to the airflow, the fins may be broken and in any shape. An example of such an embodiment is shown in FIG. 1*a* where the oil circuit is also shown underneath the plate. The air circuit is parallel, perpendicular or in any direction relative to the oil circuit. Such embodiments are massive and result in thicknesses that are unfavourable for good heat exchange, or require long machining and casting techniques that are complex and costly in trying to minimize this drawback, but they do not eliminate it. This phenomenon is all the more significant in the case of curve exchangers. Starting from a thick plate, the curvature is achieved by a 5-axis machining, which requires a large and expensive machine, and a substantial removal of material that is long and costly in terms of material. Starting with a thinner plate, the machining (3-axis) generates less chipping, but the curvature is achieved by deforming the plate, which can be critical.

Another known embodiment is shown in FIG. 1*b* and consists of a smooth plate comprising fins of any shape and mounted by welding or brazing. Such embodiments are complex to achieve and present reliability and quality problems for the exchange to the oil.

Still another embodiment as in the state of the art consists of a smooth plate comprising air channels obtained by a folded (or corrugated) sheet metal plate that is brazed or welded, with or without a closure plate for said air channels (see FIG. 1*c*). These exchangers are less complex to manufacture but present significant resistance to airflow, particularly the covered variant, and are therefore inefficient, especially if a significant dimension in the airflow direction is desired. They are also fragile, in particular the uncovered variant.

Finally, a known embodiment may also be cited, wherein the plates studded with spikes as shown in FIG. 1*d*, obtained by deep forging or special machining. This type of embodiment is also relatively fragile and/or complex to manufacture.

As far as the oil circuit is concerned, it is incorporated or attached underneath the plate. In the first case, it is partially machined. For example, grooves are cut or moulded into the body and a mounted plate is welded or brazed underneath the grooves. However, the oil channels are difficult to achieve by machining because of their great number and their small size. In the second case, the oil circuit is shaped by channels attached by various technologies. For example, tubes are welded or brazed, or even a plate is brazed underneath a corrugated sheet metal plate, etc.

AIMS OF THE INVENTION

The present invention aims to provide a solution that allows to overcome the drawbacks of the state of the art.

In particular, the invention aims to propose an air cooling system for a fluid, produced by industrial methods that are not very complex, and within a minimum of operations, while ensuring optimum heat exchange and sufficient strength.

The present invention also aims to allow a joint manufacturing of the fluid and air circuits without machining the body or casting.

MAIN CHARACTERISTIC FEATURES OF THE INVENTION

The present invention relates to a method for manufacturing an air/fluid heat exchanger, said method comprising at least the following steps:

a) on a first sheet metal plate, a plurality of tight folds are formed, said folds acting as fins, or, alternatively, the first sheet metal plate comprising a first portion and second portion, tight folds are formed only on the first portion;
   said first sheet metal plate or said first portion forming a sheet metal plate in the upper position;
b) the tight folds are opened on a portion across their height;
c) the first sheet metal plate obtained in step b) is positioned on a second sheet metal plate, said second sheet metal plate forming a sheet metal plate in the lower position,
   or, alternatively, the first portion obtained in step b) is folded on the second portion, said second portion forming a sheet metal plate in the lower position,
d) the tight portion of the folds is brazed and the first sheet metal plate is brazed onto the second sheet metal plate,
   or, alternatively, the tight part of the folds is brazed, and the first portion is brazed onto the second portion,
e) optionally, a third sheet metal plate is positioned and brazed underneath the sheet metal plate in the lower position; said third sheet metal plate forming then, the sheet metal plate in the lower position.

According to particular embodiments of the invention, the method comprises at least one or an appropriate combination of the following features:

the first, second and third sheet metal plates are respectively flat or corrugated;

when the second sheet metal plate or, alternatively, the second portion of the first sheet metal plate is flat, the third sheet metal plate is corrugated;

when the second sheet metal plate or, alternatively, the second portion of the first sheet metal plate is corrugated, the third sheet metal plate is corrugated or flat;

the corrugated sheet metal plates are spaced from peak to peak by a gap that is equal to the gap between the folds of the first sheet metal plate or of the first portion of the first sheet metal plate;

the recesses of the second corrugated sheet metal plate or, alternatively, the recesses of the second portion of the first corrugated sheet metal plate are positioned opposite the tight folds of the first sheet metal plate or the first portion of the first sheet metal plate, respectively;

the recesses of the third corrugated sheet metal plate are positioned opposite the reliefs of the second corrugated sheet metal plate or, alternatively, opposite the reliefs of the second portion of the first corrugated sheet metal plate;

in step c) and in the direction transverse to the fins, the ends of the second sheet metal plate are folded over the ends of the first sheet metal plate or, alternatively, one end of the second portion folded over the first portion at a first end is folded over the second end of the first portion;

in step d), pressure is applied in the direction respectively parallel and perpendicular to the axis of the tight folds;

perpendicular pressure is applied before parallel pressure;

in step d) or e), sealing parts are positioned in the longitudinal direction of the fins at the ends of the air/fluid exchanger;

it comprises after step d) or after step e), an additional step e') for welding filler material between the sheet metal plate in the upper position and the sealing parts;

openings are cut in the sheet metal plate in the lower position;

said openings are located next to the sealing parts;

a oil box is fixed at the level of said openings, either directly on the sheet metal plate in the lower position, or on a reinforcement part placed in step d) or e);

the fluid is oil.

The present invention also relates to an air/fluid exchanger obtained by the above-described method.

Figure 1:
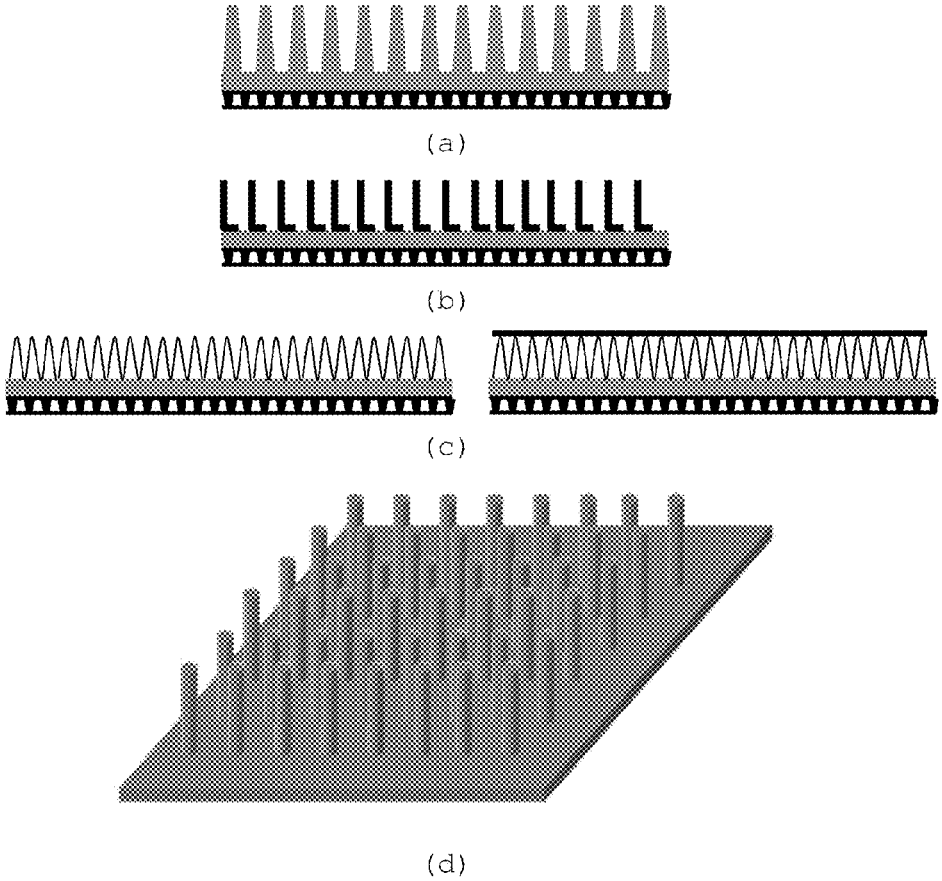
FIGS. 1*a* to 1*d*, already mentioned, schematically show ACOC-type cooling systems as in the state of the art.

KEY (1) Air/fluid heat exchanger
(2) First sheet metal plate
(2*a*) First portion of the 1$^{st}$ sheet metal plate (2)
(2*b*) Second portion of the 1$^{st}$ sheet metal plate (2)
(3) Tight folds forming the fins
(4) Channel for the passage of the fluid
(5) Braze weld
(6) Second sheet metal plate
(7) Third sheet metal plate
(8) Sealing part
(9) Weld
(10) Reinforcement bar
(11) Opening
(12) Clamping fold

DESCRIPTION OF PREFERRED EMBODIMENTS OF THE INVENTION

The invention generally relates to a method for manufacturing an air exchanger for cooling a heat-transfer fluid, the exchanger as in the invention can be used in any application where a large surface is swept by air. More particularly, the method described herein below relates to a surface ACOC exchanger that can be installed in a turbine engine.

Figure 2:
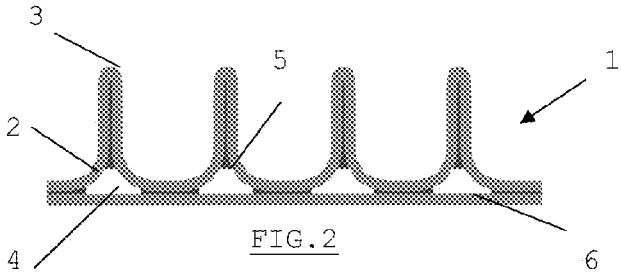
FIG. 2 schematically shows a cross-section view of an air cooling system as in the invention, said cooling system comprising two sheet metal plates.

According to the invention, a first sheet metal plate 2 is folded in a step a), with tight folds to form fins 3 (see FIG. 2). In a step b), both sides of each fold are separated at the foot of the fold over a height that is more or less significant in order to achieve an opening intended to subsequently form a channel 4 for the passage of the fluid as described below.

In a step c), the first sheet metal plate 2 thus folded, also called sheet metal plate in the upper position, is then placed over a second flat or corrugated sheet metal plate 6 in order to close the openings and thus form the channels 4 for the passage of the fluid. In the example shown in FIG. 2, the second sheet metal plate is flat and is the sheet metal plate in the lower position.

Figure 3:
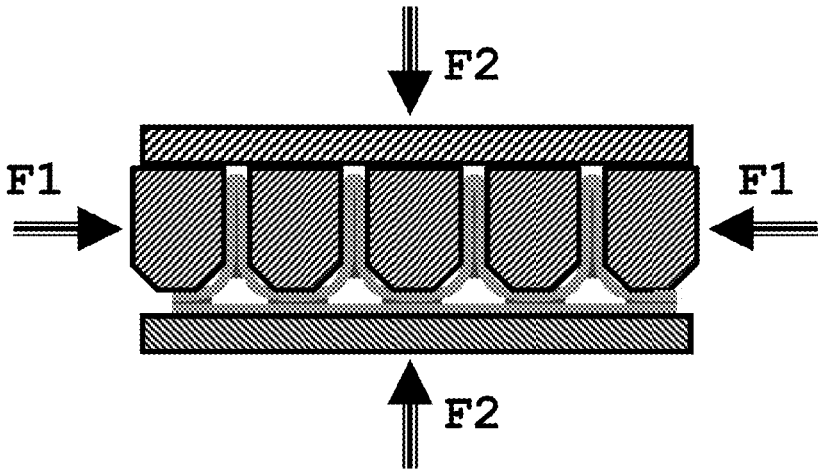
FIG. 3 schematically shows a cross-section view of the pressing principle during the brazing step.

To increase rigidity and improve the sealing of the fins in the event of impact, especially at the ends, the tight portion of the fold may advantageously be brazed (braze weld 5). Similarly, the second sheet metal plate 6 is brazed on the first sheet metal plate 2. Brazing is an assembly by means of a filler metal with a melting point that is lower than that of the metal parts to be assembled and wetting the contact surfaces by capillarity. In a step d), the braze weld of both the second sheet metal plate and the folds in a single heating is made possible by the orthogonal direction of the two sets of joints, allowing easy implementation of the tools to apply the pressure required for brazing as shown in FIG. 3. According to the invention, it is preferable to apply the horizontal pressure F1 before the vertical pressure F2. The braze weld does not provide sealing for the bottom plate, but it provides for the cohesion of the device.

Figure 4:
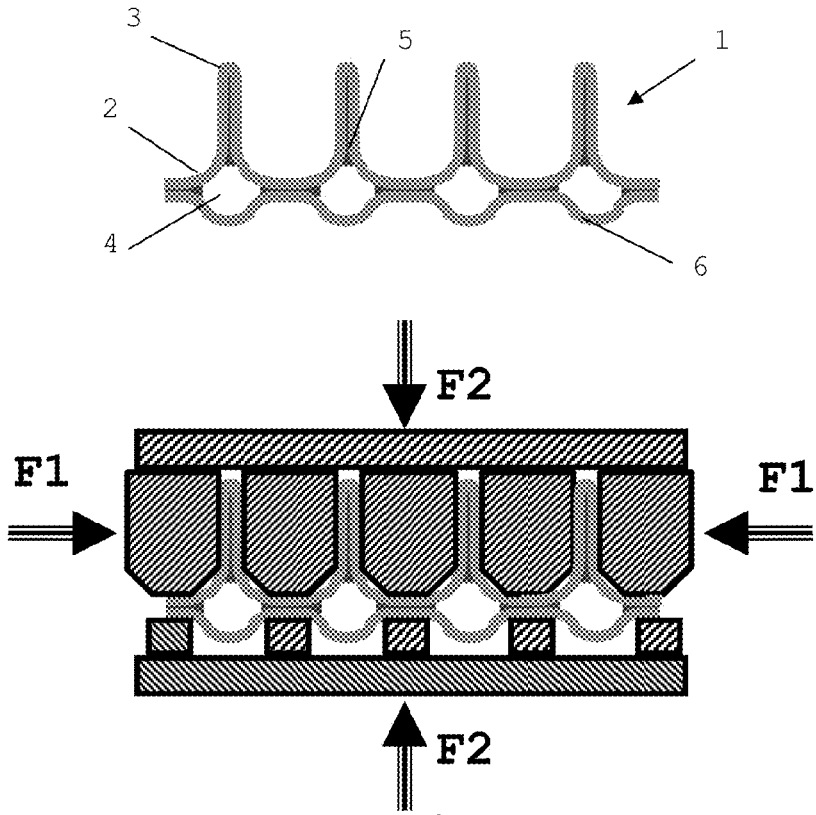
FIG. 4 schematically shows a cross-section view of a variant of the cooling system as in the invention as well as the associated variant of the pressing tooling during the brazing step.

FIG. 4 shows a variant where the second sheet metal plate 6 is corrugated and where the pressing tool is modified accordingly. The expression "corrugated sheet metal plate" means any sheet metal that has regularly alternating reliefs and recesses. According to the present invention, the hollow parts of the second sheet metal plate 6 are placed opposite the tight folds 3 of the first sheet metal plate 2 and the distance from peak to peak is equal to the gap between the tight folds.

Figure 5:
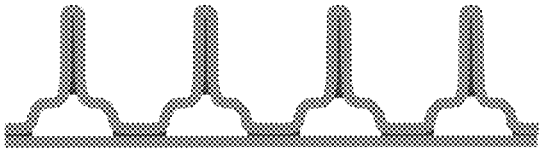
FIGS. 5, 6 and 7 schematically show the respective cross-section views of other variants of the cooling system as in the invention comprising two sheet metal plates or three sheet metal plates in the case of the variant of FIG. 7.

In yet another embodiment of the present invention shown in FIG. 5, the first sheet metal plate 2 is corrugated and the second sheet metal plate 6 is flat, thereby allowing to modify the shape of the channels 4 for the passage of the fluid.

Still according to the present invention, all variant combinations of the upper and lower sheet metal plates may be used to modify the shape of the channels.

Figure 6:
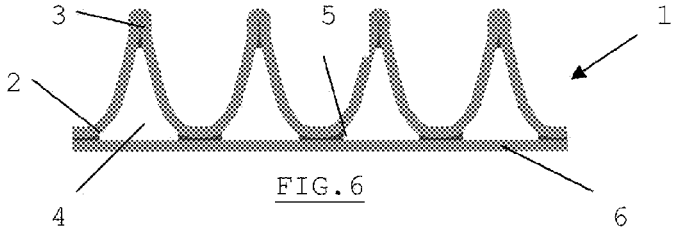

Similarly, the tight fold may be open over a more or less significant height in order to also modulate the shape and size of the channel 4 for the passage of the fluid as shown in FIG. 6.

Figure 7:
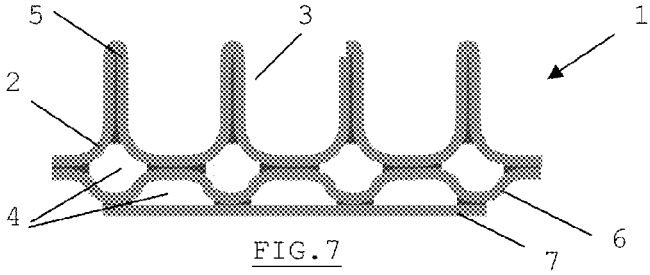

In yet another embodiment of the present invention illustrated in FIG. 7, a third sheet metal plate 7 is added and brazed in a step e) in order to double the number of oil channels 4. In this variant, the third sheet metal plate 7 is the sheet metal plate in the lower position. When the latter is corrugated and positioned underneath a second sheet metal plate 6 also corrugated, the recesses of the third sheet metal plate are placed opposite the reliefs of the second sheet metal plate in order to form the additional channels.

The side ends of the exchanger 1, i.e. in the transverse direction to the fins, are closed, either only by brazing the two (or three) sheet metal plates as shown in FIG. 2-7, or by additionally using a clamping fold (not shown).

Figure 8:
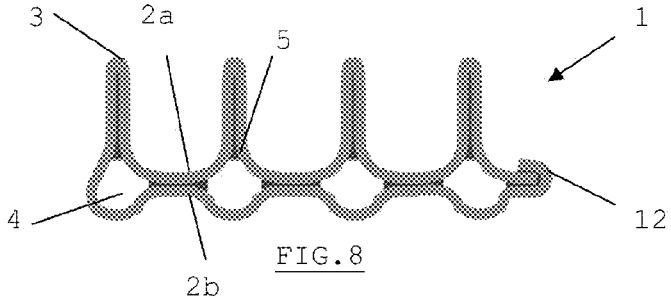
FIG. 8 schematically shows a cross-section view of another embodiment of the cooling system as in the invention comprising a single sheet metal plate.

According to yet another variant of the present invention, it is also possible to achieve the exchange plate from the only first sheet metal plate 2. In this variant, a first portion 2*a* of the first sheet metal plate 2 is folded in step a) to form the fins 3 and a second portion 2*b* of this first sheet metal plate 2 is folded over the first portion 2*a* in step b) with a clamping fold 12 to form the channels 4 for the passage of the fluid (see FIG. 8). In this embodiment of the invention, the second portion 2*b* is the sheet metal plate in the lower position. An additional sheet metal plate may also be positioned underneath the second portion 2*b* to double the number of channels. In this scenario, the additional sheet metal plate, also called the third sheet metal plate, is the sheet metal plate in the lower position.

The sealing of the front and rear ends of the exchanger, i.e. in the longitudinal direction of the fins, may be achieved in various ways. These include, for example, the use of sealing parts 8 machined or shaped in any manner whatsoever to fill the passages of the fluid, and placed in the tool in step d) or e). The local deformation of the sheet metal plates allow to close the passages during brazing, or bring the edges close enough so that classic welding 9 performed after the brazing step d) or e) in an additional step e') may ensure the sealing.

Figure 9:
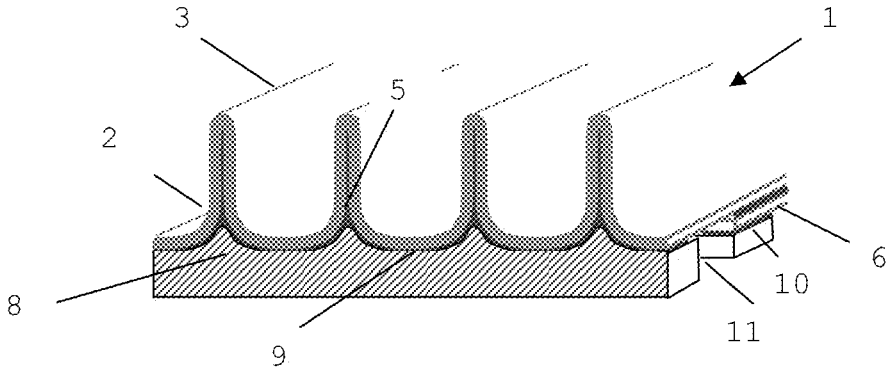
FIG. 9 schematically shows the positioning of a sealing part at one end of the cooling system as in the invention.

The connection of the oil boxes may be achieved by piercing the lower sheet metal plate 6,7 or 2*b* or by interrupting it at the entry and exit points. The boxes (not shown) are then attached by welding or any other means, to the right of these openings 11, either directly on the sheet metal plate components 6,7 or 2*b*, or on the reinforcement bars or parts 10 placed during the brazing of the assembly, as shown in FIG. 9.

ADVANTAGES OF THE METHOD AS IN THE INVENTION

The exchanger as in the present invention has in particular the following advantages:

- Ease of manufacture without machining, fast and simple industrial methods;
- Savings in materials (no removal of material, chipping) because the start point is a sheet metal plate;
- Proximity between the fins located in the airflow and the oil channels, which improves heat exchange;
- Good resistance to various stresses (pressure of a few bars for the oil flow, engine vibration, impact behind the fan).

The invention claimed is:

1. Method for manufacturing a surface heat exchanger (1), said method comprising at least the following steps:

a) corrugating a first sheet metal plate (2), by forming a plurality of folds;

b) the folds (3) including a portion that is open and a portion that is closed;

c) placing the first corrugated sheet metal plate onto (2) a second sheet metal plate (6);

d) brazing the closed portion of the folds in order to provide fins (3) to said surface heat exchanger, said fins to be located in an air flow (3) and brazing the first corrugated sheet metal plate (2) to the second sheet metal plate (6);

wherein the brazing of first corrugated sheet metal plate and second sheet metal plates joins the open portions of the first corrugated sheet metal plate with the second sheet metal plate such that openings for a fluid are formed between the first corrugated sheet metal plate and the second sheet metal plate.

2. Manufacturing method as in claim 1, wherein the second sheet metal plate is flat or corrugated.

3. Manufacturing method as in claim 2, wherein the second sheet metal plate (6) is flat.

4. Manufacturing method as in claim 1, wherein the second sheet metal plate is corrugated having alternating peaks and recesses, a distance between adjacent peaks being equal to a gap between the folds (3) of the first corrugated sheet metal plate (2).

5. Manufacturing method as in claim 4, wherein each recess of the second sheet metal plate (6) is positioned below a respective foot of the folds of the first sheet metal plate (2).

6. Manufacturing method as in claim 1, wherein, during step d), pressure is applied in a direction respectively parallel and in a direction respectively perpendicular to an axis of the folds (3).

7. Manufacturing method as in claim 6, wherein the pressure in the perpendicular direction is applied before the pressure in the parallel direction.

8. Manufacturing method as in claim 1, wherein, during step d), sealing parts (8) are placed in a longitudinal direction of the fins (3) at ends of the surface heat exchanger (1).

9. Manufacturing method as in claim 8, further comprising welding (9) filler material between the first corrugated sheet metal plate and the sealing parts (8), the sealing parts being positioned below the first sheet metal plate.

10. Manufacturing method as in claim 8, wherein openings (11) are cut in the second sheet metal plate.

11. Manufacturing method as in claim 10, wherein said openings (11) are located next to the sealing parts (8).

12. Manufacturing method as in claim 10, wherein an oil box is fixed either directly on the second sheet metal plate, or on a reinforcement part (10) attached to the second sheet metal plate.

13. Manufacturing method as in claim 1, wherein the fins are configured to exchanged heat, carried by oil, with the air flow over the fins.

14. Manufacturing method as in claim 1, wherein a third sheet metal plate (7) is placed and brazed underneath the second sheet metal plate.

15. Manufacturing method as in 14, wherein the second sheet metal plate (6) and the third sheet metal plate (7) are respectively flat or corrugated.

16. Manufacturing method as in claim 15, wherein, when the second sheet metal plate (6) is flat, the third sheet metal plate (7) is corrugated.

17. Manufacturing method as in claim 15, wherein, when the second sheet metal plate (6) is corrugated, the third sheet metal plate (7) is corrugated or flat.

18. Manufacturing method as in claim 17, wherein, when the second and third sheet metal plates are corrugated, each having alternating reliefs and recesses the recesses, of the third corrugated sheet metal plate (7) are placed opposite the reliefs of the second corrugated sheet metal plate (6).

* * * * *

UNITED STATES PATENT AND TRADEMARK OFFICE

CERTIFICATE OF CORRECTION

PATENT NO. : 8,726,507 B2
APPLICATION NO. : 12/891162
DATED : May 20, 2014
INVENTOR(S) : Denis Bajusz et al.

It is certified that error appears in the above-identified patent and that said Letters Patent is hereby corrected as shown below:

In the Claims

Column 6, line 10 claim 1, -- (3) -- should be inserted after -- of the folds --.

Column 6, line 33 claim 5, "(2)" should be deleted.

Column 6, line 46 claim 9, -- (8) -- should be inserted after the second instance of -- sealing parts --.

Column 7, line 6 claim 18, the "," should be deleted.

Signed and Sealed this
Fifth Day of August, 2014

Michelle K. Lee

Michelle K. Lee
*Deputy Director of the United States Patent and Trademark Office*